US010603861B2

(12) United States Patent
Totani

(10) Patent No.: US 10,603,861 B2
(45) Date of Patent: Mar. 31, 2020

(54) PLASTIC BAG MAKING APPARATUS

(71) Applicant: Totani Corporation, Kyoto (JP)

(72) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 312 days.

(21) Appl. No.: 15/556,003

(22) PCT Filed: Mar. 23, 2016

(86) PCT No.: PCT/JP2016/059217
§ 371 (c)(1),
(2) Date: Sep. 6, 2017

(87) PCT Pub. No.: WO2016/152925
PCT Pub. Date: Sep. 29, 2016

(65) Prior Publication Data

US 2018/0056619 A1 Mar. 1, 2018

(30) Foreign Application Priority Data

Mar. 24, 2015 (JP) ..... 2015-060938

(51) Int. Cl.
*B31B 50/26* (2017.01)
*B31B 50/64* (2017.01)
(Continued)

(52) U.S. Cl.
CPC ..... *B31B 50/26* (2017.08); *B31B 50/64* (2017.08); *B31B 50/644* (2017.08); *B31B 70/10* (2017.08);
(Continued)

(58) Field of Classification Search
CPC ..... B31B 50/26; B31B 50/64; B31B 50/644; B31B 70/10; B31B 70/148; B31B 70/18;
(Continued)

(56) References Cited

U.S. PATENT DOCUMENTS 6,425,847 B1 * 7/2002 Broenstrup ..... B31B 70/00 493/186
2005/0272583 A1 * 12/2005 Totani ..... B31B 70/00 493/162

(Continued)

FOREIGN PATENT DOCUMENTS

JP 2011-020719 2/2011
JP 2011-161665 8/2011
JP 2011-255629 12/2011

(Continued)

OTHER PUBLICATIONS

International Search Report dated Jun. 10, 2016 in corresponding International patent application No. PCT/JP2016/059217.

*Primary Examiner* — Andrew M Tecco
*Assistant Examiner* — Nicholas E Igbokwe
(74) *Attorney, Agent, or Firm* — Kirschstein, Israel, Schiffmiller & Pieroni, P.C.

(57) ABSTRACT

An apparatus successively makes plastic bags each of which includes an end surface provided with a protrusion, without specially supplying a web of bottom gusset material. A first web of panel material is folded along a first folded line at a position adjacent to a side edge of the first web, while a second web of panel material is folded along a second folded line at a position adjacent to a corresponding side edge of the second web. A first folded portion is formed in the first web. There exists a distance between the side edge and the first folded line, which is larger than twice a distance between the corresponding side edge and the second folded line by a predetermined distance, after being folded. The end surface is formed by the first folded portion, the protrusion being formed by the predetermined distance.

1 Claim, 4 Drawing Sheets

(51) Int. Cl.

| | |
|---|---|
| ***B31B 70/84*** | (2017.01) |
| ***B31B 70/36*** | (2017.01) |
| ***B31B 70/14*** | (2017.01) |
| ***B31B 70/10*** | (2017.01) |
| ***B31B 70/18*** | (2017.01) |
| ***B31B 70/26*** | (2017.01) |
| *B31B 150/20* | (2017.01) |
| *B31B 155/00* | (2017.01) |
| *B31B 160/20* | (2017.01) |

(52) U.S. Cl.
CPC ..... *B31B 70/148* (2017.08); *B31B 70/18* (2017.08); *B31B 70/262* (2017.08); *B31B 70/36* (2017.08); *B31B 70/844* (2017.08); *B31B 2150/20* (2017.08); *B31B 2155/002* (2017.08); *B31B 2160/20* (2017.08)

(58) Field of Classification Search
CPC ..... B31B 70/262; B31B 70/36; B31B 70/844; B31B 2150/20; B31B 2155/00; B31B 2155/0014; B31B 2155/003; B65D 31/10
USPC ..... 493/189, 186
See application file for complete search history.

(56) References Cited

U.S. PATENT DOCUMENTS

| | | | | |
|---|---|---|---|---|
| 2010/0290722 | A1* | 11/2010 | DeSmedt | B65D 31/10 383/120 |
| 2011/0015052 | A1* | 1/2011 | Totani | B65D 31/08 493/189 |
| 2011/0077139 | A1* | 3/2011 | Kujat | B31B 70/00 493/267 |
| 2012/0035035 | A1* | 2/2012 | Totani | B31B 37/00 493/193 |
| 2015/0005148 | A1* | 1/2015 | Ohmae | B65D 75/008 493/194 |

FOREIGN PATENT DOCUMENTS

| | | |
|---|---|---|
| JP | 2013-159093 | 8/2013 |
| WO | 2004009341 | 1/2004 |

* cited by examiner

PLASTIC BAG MAKING APPARATUS

TECHNICAL FIELD

The invention relates to an apparatus for successively making plastic bags.

BACKGROUND

In the apparatus for successively making plastic bags, in general, first and second webs of panel material are superposed on each other and fed longitudinally thereof, to successively make the plastic bags of the first and second webs, as described in Patent Document 1. The same is true of an apparatus of Patent Document 2.

In the apparatus of Patent Document 1, the plastic bag includes an end surface and a protrusion. A web of bottom gusset material is disposed longitudinally of and interposed between the webs of panel material so that the end surface is formed by the web of bottom gusset material, the end surface being provided with the protrusion. The protrusion can be provided with a handle hole, a zipper or a pouring port. The protrusion may be provided with an inlet port through which content is injected, the plastic bag being filled with the content.

On the other hand, in the apparatus of Patent Document 2, the apparatus includes a panel material guide device by which the first and second webs of panel material are guided when being fed so that the first web of panel material is folded along a first folded line at a position adjacent to a side edge of first web of panel material while the second web of panel material is folded along a second folded line at a position adjacent to a corresponding side edge of second web of panel material. A first folded portion is therefore formed in the first web of panel material, a second folded portion being formed in the second web of panel material. The first folded portion is superposed on the second folded portion, the end surface being formed by the first folded portion.

In the apparatus of Patent Document 2 in which the end surface is formed by the first folded portion, unlike the apparatus of Patent Document 1, no web of bottom gusset material has to be supplied specially. The apparatus can therefore be simple in structure and low in cost. However, on the other side of the coin, the plastic bag cannot include the end surface provided with the protrusion. In order to be provided with the protrusion, the web of bottom gusset material has to be supplied specially and interposed between the first and second webs of panel material, as in the case of the apparatus of Patent Document 1. The apparatus must therefore be complicated in structure and high in cost.

In terms of the above, it is desired to provide a new and improved apparatus which can successively make plastic bags each of which includes the end surface provided with the protrusion, without making the web of bottom gusset material supplied specially, to be simple in structure and low in cost.

Patent Document 3 discloses an apparatus for successively making plastic bags each of which includes an end surface, another end surface and a spout. The content is taken out through the spout.

It is therefore desired to provide the apparatus in which the plastic bag includes the end surface provided with the protrusion, the protrusion being provided with the inlet port through which the content is injected, the plastic bag further including the another end surface provided with the spout through which the content is taken out.

It is also desired to provide the apparatus in which the plastic bag includes the end surface provided with not only the protrusion but also the spout.

It is therefore an object of the invention to provide a new and improved apparatus which can successively make plastic bags each of which includes an end surface provided with a protrusion, without making a web of bottom gusset material supplied specially.

Another object is to make the protrusion provided with an inlet port.

Another object is to make the plastic bag include another end surface provided with a spout.

Another object is to make the plastic bag include an end surface provided with a spout.

PRIOR ART DOCUMENT

[Patent Document]

[Patent Document 1] Japanese Patent Publication No. 4,526,592

[Patent Document 2] Japanese Patent Publication No. 3,655,627

[Patent Document 3] Japanese Laid-Open Patent Publication No. 159,093 of 2013

SUMMARY OF THE INVENTION

According to the invention, in an apparatus for successively making plastic bags each of which includes an end surface provided with a protrusion, first and second webs of panel material are superposed on each other and fed longitudinally thereof. The apparatus includes a panel material guide device by which the first and second webs of panel material are guided when being fed so that the first web of panel material is folded along a first folded line at a position adjacent to a side edge of first web of panel material while the second web of panel material is folded along a second line at a position adjacent to a corresponding side edge of second web of panel material. A first folded portion is therefore formed in the first web of panel material, a second folded portion being formed in the second web of panel material. The first folded portion is superposed on the second folded portion. In addition, according to the invention, there exists a distance between the side edge and the first folded line, which is larger than twice a distance between the corresponding side edge and the second folded line by a predetermined distance after the first and second webs of panel material are folded along the first and second folded lines. The side edge and the corresponding side edge are aligned with each other when the first folded portion is superposed on the second folded portion. The end surface is therefore formed by the first folded portion, the protrusion being formed by the predetermined distance.

In a preferred embodiment, the side edge is positioned beyond and outwardly of the corresponding side edge by a fixed distance before the first and second webs of panel material are folded. The fixed distance is larger than twice the distance between the corresponding side edge and the second folded line by twice the predetermined distance.

In the apparatus in which the protrusion is provided with an inlet port, the first web of panel material is slit along the first folded line when being fed after being folded so that an opening is formed in the first folded portion, the inlet port being formed by the opening.

The first and second webs of panel material are fed intermittently.

In the apparatus in which the plastic bag includes opposite side surfaces in addition to the end surface and the protrusion, sheets of side gusset material are supplied to the first web of panel material one by one to be disposed widthwise thereof whenever the webs of panel material are fed intermittently before being superposed. The sheet of side gusset material is therefore interposed between the first and second webs of panel material when the first and second webs of panel material are superposed. The apparatus further includes a temporarily fixing device by which the second web of panel material and the sheet of side gusset material are temporarily fixed to each other at a position adjacent to an end edge of sheet of side gusset material whenever the webs of panel material are fed intermittently after being superposed. The sheet of side gusset material is therefore opened by the second web of panel material at the position adjacent to the end edge of sheet of side gusset material when the second web of panel material is folded along the second folded line. The first folded portion is superposed on the sheet of side gusset material which is opened when the first web of panel material is folded along the first folded line. The side surfaces are therefore formed by the sheets of side gusset material.

The apparatus further includes a longitudinal seal device by which the first and second folded portions are heat sealed with each other longitudinally of the webs of panel material whenever the webs of panel material are fed intermittently. The apparatus further includes a cross seal device by which the webs of panel material and the sheet of side gusset material are heat sealed with each other widthwise of the webs of panel material whenever the webs of panel material are fed intermittently.

In the apparatus in which the plastic bag includes another end surface in addition to the end surface and the protrusion, the another end surface being provided with a spout, the apparatus further includes an additional guide device by which the first and second webs of panel material are guided when being fed so that the first web of panel material is folded along a third folded line at a position adjacent to another side edge of first web of panel material while the second web of panel material is folded along a fourth folded line at a position adjacent to a corresponding another side edge of second web of panel material. A third folded portion is therefore formed in the first web of panel material, a fourth folded portion being formed in the second web of panel material. The third folded portion is superposed on the fourth folded portion. In addition, there exists a distance between the another side edge and the third folded line, which corresponds to twice the distance between the corresponding another side edge and the fourth folded line after the first and second webs of panel material are folded along the third and fourth folded lines. The another side edge and the corresponding another side edge are aligned with each other when the third folded portion is superposed on the fourth folded portion. In addition, an aperture is formed in the first web of panel material, a spout being inserted into the aperture, between the another side edge and the third folded line whenever the webs of panel material are fed intermittently before the first web of panel material is folded, the spout being turned over by the third folded portion when the first web of panel material is folded along the third folded line. The another end surface is therefore formed by the third folded portion, the third folded portion being provided with the spout.

The apparatus further includes a longitudinal seal device by which the third and fourth folded portions are heat sealed with each other longitudinally of the webs of panel material whenever the webs of panel material are fed intermittently.

In another embodiment in which the plastic bag includes the end surface provided with the spout, the aperture is formed in the first web of panel material, the spout being inserted into the aperture, between the side edge and the first folded line whenever the webs of panel material are fed intermittently before the first web of panel material is folded, the spout being turned over by the first folded portion when the first web of panel material is folded along the first folded line. The first folded portion is therefore provided with the spout.

BEST MODE TO CARRY OUT THE INVENTION

Embodiments of the invention are as follows.

Figure 1:
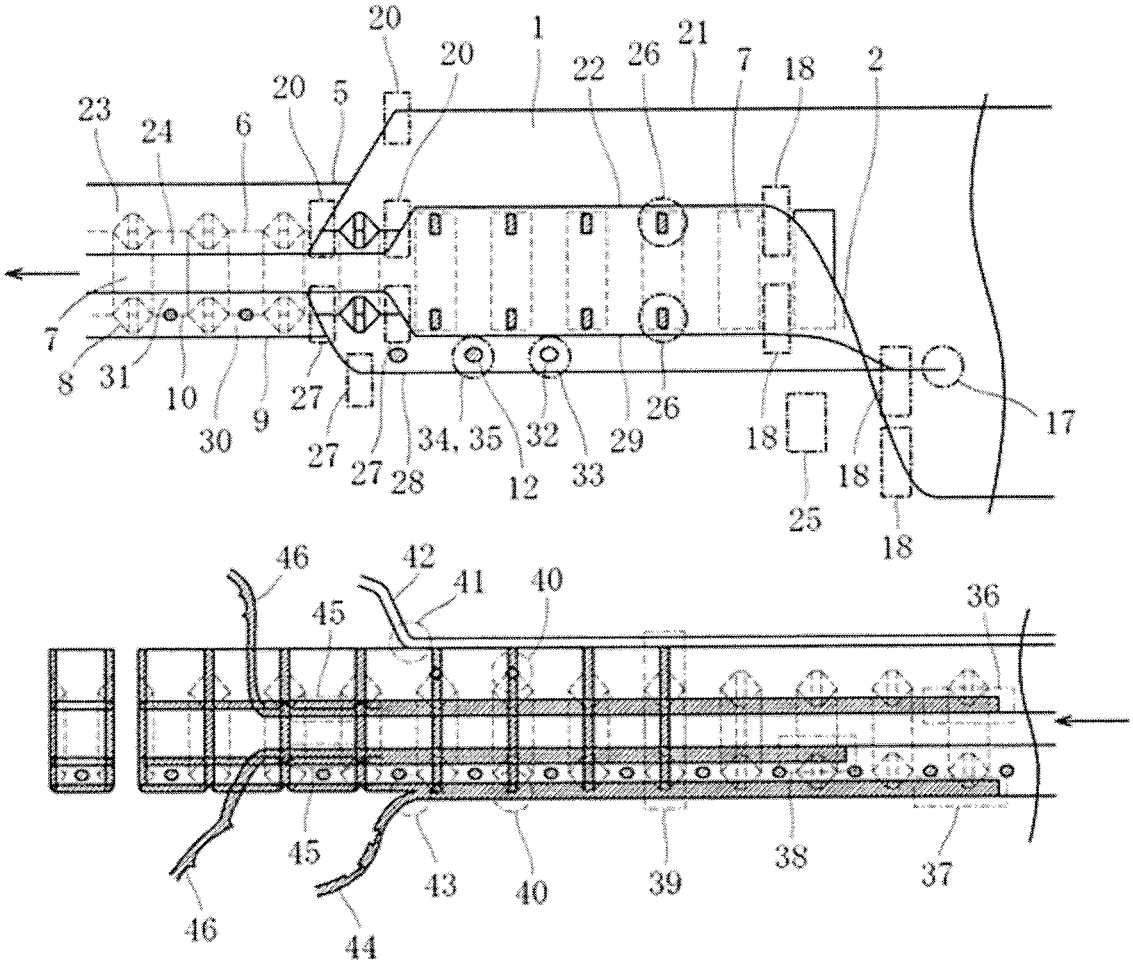
FIG. 1 is a plan view of a preferred embodiment of the invention.
Figure 4A:
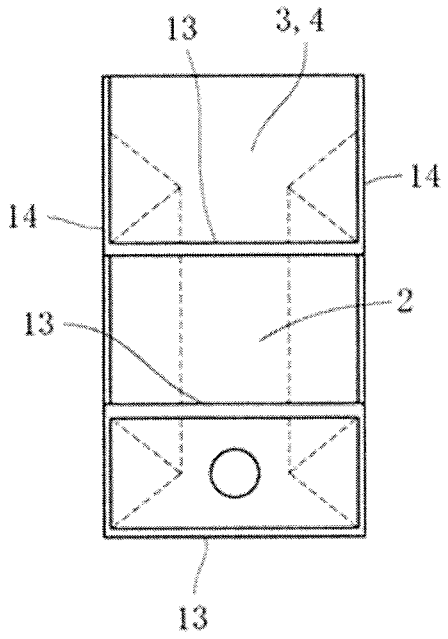
FIG. 4 is a plan view (A) of the plastic bag obtained by the apparatus of FIG. 1, an explosive view (B) of the plastic bag of (A), a perspective view (C) of the plastic bag of (A) after being filled with the content and a perspective view (D) of the protrusion of (C) after being cut.
Figure 4B:
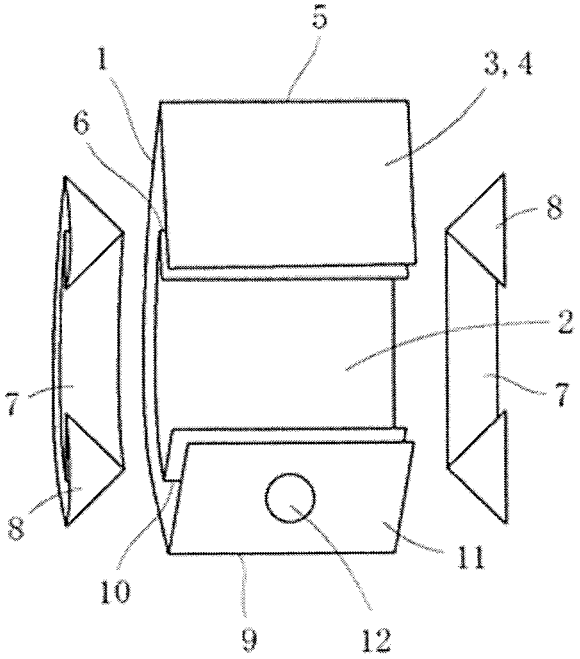

FIG. 1 illustrates an apparatus according to the invention. The apparatus is arranged to successively make plastic bags of FIG. 4. The plastic bag is composed of first and second webs of panel material 1 and 2 to include an end surface 3 and a protrusion 4. The first and second webs of panel material 1 and 2 are superposed on each other, the plastic bag including front and rear surfaces formed of the first and second webs of panel material 1 and 2. The first and second webs of panel material 1 and 2 are folded along first and second folded lines 5 and 6 to make the end surface 3 formed, the end surface 3 being provided with the protrusion 4 (FIG. 4A, FIG. 4B).

Sheets of side gusset material 7 are interposed between the first and second webs of panel material 1 and 2 so that opposite side surfaces are formed by the sheets of side gusset material 7. The sheets of side gusset material 7 are the same as the sheets of side gusset material of Patent Document 2 to have auxiliary gusset portions 8. However, unlike the plastic bag of Patent Document 2 in which the first web of panel material 1 is folded back along a folded back line to make the auxiliary gusset portion 8 closed after the first and second webs of panel material 1 and 2 are folded, the first web of panel material 1 is not folded back along the folded back line after being folded to keep the auxiliary gusset portion 8 opening.

In addition, the first and second webs of panel material 1 and 2 are folded along third and fourth folded lines 9 and 10 to make another end surface 11 formed, the another end surface 11 being provided with a spout 12. The first web of panel material 1 is not folded back along a folded back line after being folded to keep the auxiliary gusset portion 8 opening. The spout 12 is the same as the spout of Patent Document 3.

The first and second webs of panel material 1 and 2 are heat sealed with each other to make heat sealed portions 13 formed, the first and second webs of panel material 1 and 2 and the sheet of side gusset material 7 being heat sealed with each other to make heat sealed portions 14 formed. The first web of panel material 1 is slit along the first folded line 5 to make an inlet port 15 formed.

Figure 4C:
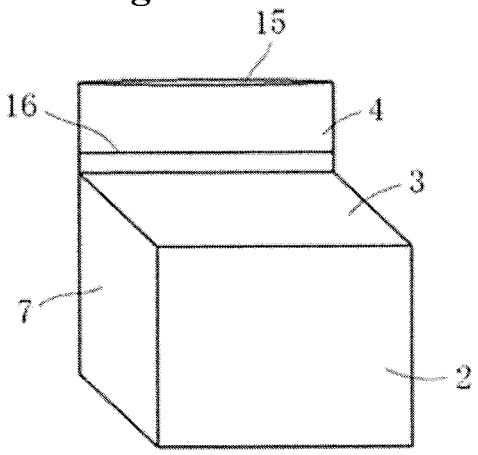

Content is injected into the plastic bag through the inlet port 15 after making the plastic bag, so that the plastic bag is inflated, the first and second webs of panel material 1 and 2 being pushed and separated from each other, with the content. The first and second webs of panel material 1 and 2 are restrained to each other by the heat sealed portions 13 while the webs of panel material 1 and 2 and the sheets of side gusset material 7 are restrained to each other by the heat sealed portions 14. The first and second webs of panel material 1 and 2 and the sheets of side gusset material 7 are therefore unfolded respectively so that the end surface 3 and the another end surface 11 are formed by the first web of panel material 1, the opposite side surfaces being formed by the sheets of side gusset material 7, the plastic bag having a cubic or rectangular shape (FIG. 4C). The protrusion 4 is formed between the front or rear surface and the end surface 3 to have a height and protrude outwardly.

Figure 4D:
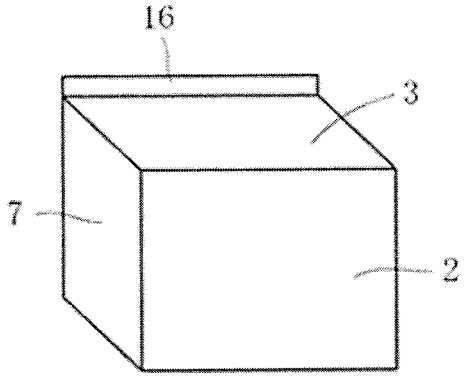

The protrusion 4 is then heat sealed along the end surface 3 to make a heat sealed portion 16 formed so that the inlet port 15 is closed by the heat sealed portion 16. The protrusion 4 may be cut along the heat sealed portion 16 after being heat sealed (FIG. 4D). The content can then be taken out through the spout 12.

The content can be injected into the plastic bag not through the spout 12 but through the inlet port 15. The inlet port 15 is larger than the spout 12 considerably. The content can therefore be injected without difficulty, when being injected by a filling machine.

In order to successively make the plastic bags of FIG. 4, in the apparatus of FIG. 1, the first and second webs of panel material 1 and 2 are superposed on each other and fed longitudinally thereof. The first and second webs of panel material 1 and 2 comprise plastic films. In the embodiment, a wide web of panel material is supplied from a roll and fed longitudinally thereof to be directed to a slitting blade 17 by which the wide web of panel material is slit when being fed to be divided into the first and second webs of panel material 1 and 2. The second web of panel material 2 is then guided by a panel material guide device 18 to be turn over, the second web of panel material 2 being directed above the first web of panel material 1, so that the first and second webs of panel material 1 and 2 are superposed on each other. For example, the panel material guide device 18 includes guide rollers and plates by which the second web of panel material 2 is guided to be turn over, as in the case of the apparatus of Patent Document 2.

Figure 2:
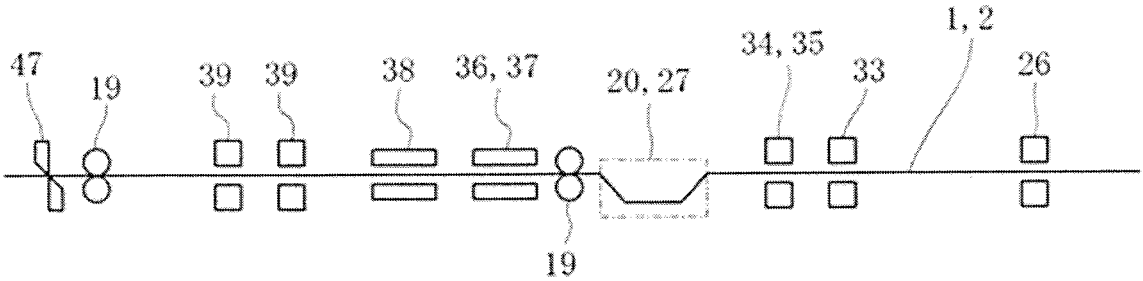
FIG. 2 is a side view of the apparatus of FIG. 1.

The apparatus includes panel material feeding device comprising feeding rollers 19 to which the first and second webs of panel material 1 and 2 are directed, as shown in FIG. 2. The feeding rollers 19 are rotated by a drive motor to make the first and second webs of panel material 1 and 2 fed. The first and second webs of panel material 1 and 2 are therefore superposed on each other and fed longitudinally thereof. The feeding rollers 19 are rotated intermittently so that the first and second webs of panel material 1 and 2 are fed intermittently.

The first and second webs of panel material may be supplied from rolls and superposed on each other, without making the wide web of panel material supplied. In this case, it is not required to make the wide web of panel material slit by the slitting blade.

The apparatus further includes a panel material guide device 20 by which the first and second webs of panel material 1 and 2 are guided when being fed so that the first web of panel material 1 is folded along a first folded line 5 at a position adjacent to a side edge 21 of first web of panel material 1 while the second web of panel material 2 is folded along a second folded line 6 at a position adjacent to a corresponding side edge 22 of second web of panel material 2. A first folded portion 23 is therefore formed in the first web of panel material 1, a second folded portion 24 being formed in the second web of panel material 2. The first folded portion 23 is superposed on the second folded portion 24. For example, the panel material guide device 20 includes guide rollers or plates by which the first and second webs of panel material 1 and 2 are guided to be folded, as in the case of the panel material guide device of Patent Document 2.

Figure 3A:
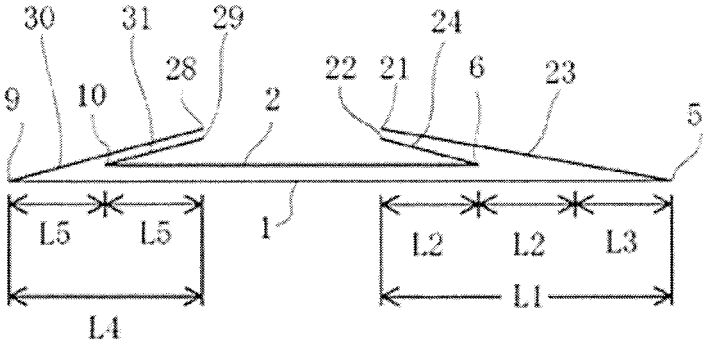
FIG. 3 is an explanatory view (A) of the first and second webs of panel material of FIG. 1 after being folded and an explanatory view (B) of the first and second webs of panel material of (A) before being folded.

In addition, in the apparatus, there exists a distance L1 between the side edge 21 and the first folded line 5, which is larger than twice a distance L2 between the corresponding side edge 22 and the second folded line 6 by a predetermined distance L3 after the first and second webs of panel material 1 and 2 are folded along the first and second folded lines 5 and 6, as shown in FIG. 3. The side edge 21 and the corresponding side edge 22 are aligned with each other when the first folded portion 23 is superposed on the second folded portion 24 (FIG. 3A). The apparatus then successively makes the plastic bags as they are, as described later. The end surface 3 is therefore formed by the first folded portion 23, the protrusion 4 being formed by the predetermined distance L3, after making the plastic bag.

Figure 3B:
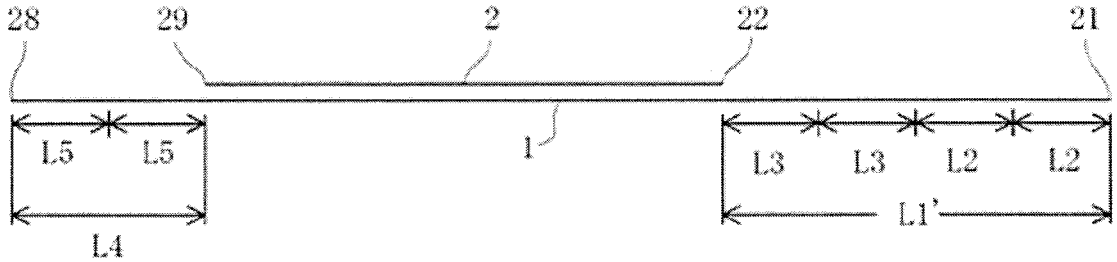

The side edge 21 is positioned beyond and outwardly of the corresponding side edge 22 by a fixed distance L1' before the first and second webs of panel material 1 and 2 are folded (FIG. 3B). The fixed distance L1' is larger than twice the distance L2 between the corresponding side edge 22 and the second folded line 6 by twice the predetermined distance L3. The first and second webs of panel material 1 and 2 are then folded as they are. It should therefore be understood that there exists the distance L1 between the side edge 21 and the first folded line 5, which is larger than twice the distance L2 between the corresponding side edge 22 and the second folded line 6 by the predetermined distance L3 after the first and second webs of panel material 1 and 2 are folded.

In the apparatus, sheets of side gusset material 7 are supplied to the first web of panel material 1 one by one to be disposed widthwise thereof whenever the webs of panel material 1 and 2 are fed intermittently before being superposed. The sheet of side gusset material 7 is therefore interposed between the first and second webs of panel material 1 and 2 when the first and second webs of panel material 1 and 2 are superposed. The apparatus includes a side gusset material supply device 25 by which the sheets of side gusset material 7 are supplied. The side gusset material supply device 25 is the same as that of Patent Document 2.

The apparatus further includes a temporarily fixing device 26 by which the second web of panel material 2 and the sheet of side gusset material 7 are temporarily fixed to each other at a position adjacent to an end edge of sheet of side gusset material 7 whenever the webs of panel material 1 and 2 are fed intermittently after being superposed. The temporarily fixing device 26 is the same as that of Patent Document 2, which comprises a ultrasonic seal device or a heat seal device. The first web of panel material 1 and the sheet of side gusset material 7 are also temporarily fixed to each other by the temporarily fixing device 26. The sheet of side gusset material 7 is therefore opened by the second web of panel material 2 at the position adjacent to the end edge of sheet of side gusset material 7 when the second web of panel material 2 is folded along the second folded line 6. The first folded portion 23 is superposed on the sheet of side gusset material 7 which is opened when the first web of panel material 1 is folded along the first folded line 5. The apparatus then makes the plastic bags as they are. The side surfaces are therefore formed by the sheets of side gusset material 7 after making the plastic bag.

The apparatus further includes an additional guide device 27 by which the first and second webs of panel material 1 and 2 are guided when being fed so that the first web of panel material 1 is folded along a third folded line 9 at a position adjacent to another side edge 28 of first web of panel material 1 while the second web of panel material 2 is folded along a fourth folded line 10 at a position adjacent to a corresponding another side edge 29 of second web of panel material 2. A third folded portion 30 is therefore formed in the first web of panel material 1, a fourth folded portion 31 being formed in the second web of panel material 2. The third folded portion 30 is superposed on the fourth folded portion 31. For example, the additional guide device 27 includes guide rollers or plates by which the first and second webs of panel material 1 and 2 are guided to be folded, as in the case of the panel material guide device 20.

There exists a distance L4 between the another side edge 28 and the third folded line 9, which corresponds to twice the distance L5 between the corresponding another side edge 29 and the fourth folded line 10 after the first and second webs of panel material 1 and 2 are folded along the third and fourth folded lines 9 and 10. The another side edge 28 and the corresponding another side edge 29 are aligned with each other when the third folded portion 30 is superposed on the fourth folded portion 31.

The another side edge 28 is positioned beyond and outwardly of the corresponding another side edge 29 by a fixed distance L4 before the first and second webs of panel material 1 and 2 are folded. The fixed distance L4 corresponds to twice the distance L5 between the corresponding another side edge 29 and the fourth folded line 10. The first and second webs of panel material 1 and 2 are folded as they are. It should therefore be understood that there exists the distance L4 between the another side edge 28 and the third folded line 9, which corresponds to twice the distance L5 between the corresponding another side edge 29 and the fourth folded line 10 after the first and second webs of panel material 1 and 2 are folded.

An aperture 32 is formed in the first web of panel material 1, a spout 12 being inserted into the aperture 32, between the another side edge 28 and the third folded line 9 whenever the webs of panel material 1 and 2 are fed intermittently before the first web of panel material 1 is folded. For example, the apparatus includes an aperture forming device 33 comprising a punch by which the first web of panel material 1 is punched to make the aperture 32 formed whenever the webs of panel material 1 and 2 are fed intermittently, as in the case of the apparatus of Patent Document 3. The apparatus further includes a spout inserting device 34 comprising a robot by which the spout 12 is inserted whenever the webs of panel material 1 and 2 are fed intermittently. The apparatus further includes a spout seal device 35 by which the spout 12 and the first web of panel material 1 are heat sealed with each other, the spout 12 being turned over by the third folded portion 30 when the first web of panel material 1 is folded along the third folded line 9. The another end surface 11 is therefore formed by the third folded portion 30 after making the plastic bag, the third folded portion 30 being provided with the spout 12.

The apparatus includes the temporarily fixing device 26 by which the second web of panel material 2 and the sheet of side gusset material 7 are temporarily fixed to each other while the first web of panel material 1 and the sheet of side gusset material 7 are temporarily fixed to each other at a position adjacent to another end edge of sheet of side gusset material 7 when the second web of panel material 2 and the sheet of side gusset material 7 are temporarily fixed to each other while the first web of panel material 1 and the sheet of side gusset material 7 are temporarily fixed to each other at the position adjacent to the end edge of sheet of side gusset material 7. The sheet of side gusset material 7 is therefore opened by the second web of panel material 2 at the position adjacent to the another end edge of sheet of side gusset material 7 when the second web of panel material 2 is folded along the fourth folded line 10. The third folded portion 30 is superposed on the sheet of side gusset material 7 which is opened when the first web of panel material 1 is folded along the third folded line 9. The apparatus then makes the plastic bags as they are.

The apparatus further includes longitudinal seal devices 36, 37 and 38 and a cross seal device 39 to which the first and second webs of panel material 1 and 2 are directed. The first and second folded portions 23 and 24 are heat sealed with each other longitudinally of the webs of panel material 1 and 2 by the longitudinal seal device 36 whenever the webs of panel material 1 and 2 are fed intermittently. The first and second folded portions 23 and 24 are heat sealed with each other along the side edge 21 and the corresponding side edge 22. The first web of panel material 1 and the third folded portion 30 are heat sealed with each other longitudinally of the webs of panel material 1 and 2 by the longitudinal seal device 37 while the third and fourth folded portions 30 and 31 are heat sealed with each other longitudinally of the webs of panel material 1 and 2 by the longitudinal seal device 38 whenever the webs of panel material 1 and 2 are fed intermittently. The first and second webs of panel material 1 and 2 and the sheet of side gusset material 7 are heat sealed with each other widthwise of the webs of panel material 1 and 2 by the cross seal device 39. The first and second webs of panel material 1 and 2 and the sheet of side gusset material 7 are heat sealed with each other along the longitudinal center line of the sheet of side gusset material 7, as in the case of the apparatus of Patent Document 1.

The apparatus further includes a corner cut device 40 comprising punches by which the first web of panel material 1, the first and third folded portions 23 and 30 and the sheet of side gusset material 7 are punched to make the plastic bag corner cut.

The first web of panel material 1 and the first folded portion 23 are directed to a slitting blade 41 to be slit along the first folded line 5 when being fed, making a selvage 42 and an inlet port 15 formed. The selvage 42 is recovered conveniently. The first web of panel material 1 and the third folded portion 30 are directed to a slitting blade 43 to be slit along the third folded line 9 when being fed, making a selvage 44 and a heat sealed portion 13 formed. The selvage 44 is recovered conveniently.

The apparatus further includes a folded portion cutting device 45 comprising Thomson blades by which the first and second folded portions 23 and 24 are cut, the third and fourth folded portions 30 and 31 being also cut, longitudinally of the webs of panel material 1 and 2 whenever the webs of panel material 1 and 2 are fed intermittently. The first and second folded portions 23 and 24 are cut along the side edge 21 and the corresponding side edge 22 while the third and fourth folded portions 30 and 31 are cut along the another side edge 28 and the corresponding another side edge 29. The first and second folded portions 23 and 24 are cut for a length, the third and fourth folded portions 30 and 31 being also cut for a length, to make selvages 46 formed. The selvages 46 are recovered conveniently. Each of the folded portions 23, 24, 30 and 31 are cut obliquely at the opposite ends of the Thomson blades to make the plastic bags corner cut.

The first and second webs of panel material 1 and 2 are then directed to a cutter 47 so that the webs of panel material 1 and 2 and the sheet of side gusset material 7 are cut widthwise of the webs of panel material 1 and 2 by the cutter 47 whenever the webs of panel material 1 and 2 are fed intermittently. The webs of panel material 1 and 2 and the sheet of side gusset material 7 are cut along the longitudinal centerline of the sheet of side gusset material 7.

Consequently, the apparatus successively makes the plastic bags.

In the apparatus, the end surface 3 is formed by the first folded portion 23, the protrusion 4 being formed by the predetermined distance L3. Accordingly, unlike the apparatus of Patent Document 1, the web of bottom gusset material does not have to be supplied specially. The apparatus can successively make plastic bags each of which includes the end surface 3 provided with the protrusion 4, without making the web of bottom gusset material supplied specially, to be simple in structure and low in cost.

In addition, the protrusion 4 is provided with the inlet port 15. The content can therefore be injected through the inlet port 15 after making the plastic bag, the plastic bag being filled with the content.

The side surfaces are formed by the sheets of side gusset material 7, the another end surface 11 being formed by the third folded portion 30, the third folded portion 30 being provided with the spout 12. The content can therefore be taken out through the spout 12, after the plastic bag is filled with the content.

The protrusion 4 may be provided with a handle hole, a zipper or a pouring port, as in the case of the plastic bag of Patent Document 1. However, the protrusion 4 cannot be provided with the inlet port 15 through which the content is injected, when being provided with the handle hole. The content has therefore to be injected through the spout 12.

The protrusion 4 may be heat sealed along the end surface 3 to make the heat sealed portion 16 formed, before the content is injected. The protrusion 4 is then cut along the heat sealed portion 16. However, in this case, the content has to be injected through the spout 12 just the same.

In the apparatus, there exists the distance L1 between the side edge 21 and the first folded line 5, which is larger than twice the distance L2 between the corresponding side edge 22 and the second folded line 6 by the predetermined distance L3 after the first and second webs of panel material 1 and 2 are folded along the first and second folded lines 5 and 6, as described previously. The protrusion 4 is therefore formed by the predetermined distance L3. In this connection, it should be understood that no protrusion is formed when there exists the distance L1 between the side edge 21 and the first folded line 5, which corresponds to twice the distance L2 between the corresponding side edge 22 and the second folded line 6. The end surface 3 is formed by the first folded portion 23, the side surfaces being formed by the sheets of side gusset material 7, the another end surface 11 being formed by the third folded portion 30, the third folded portion 30 being provided with the spout 12, after making the plastic bag, as in the case of the embodiment of FIG. 1.

Figure 5:
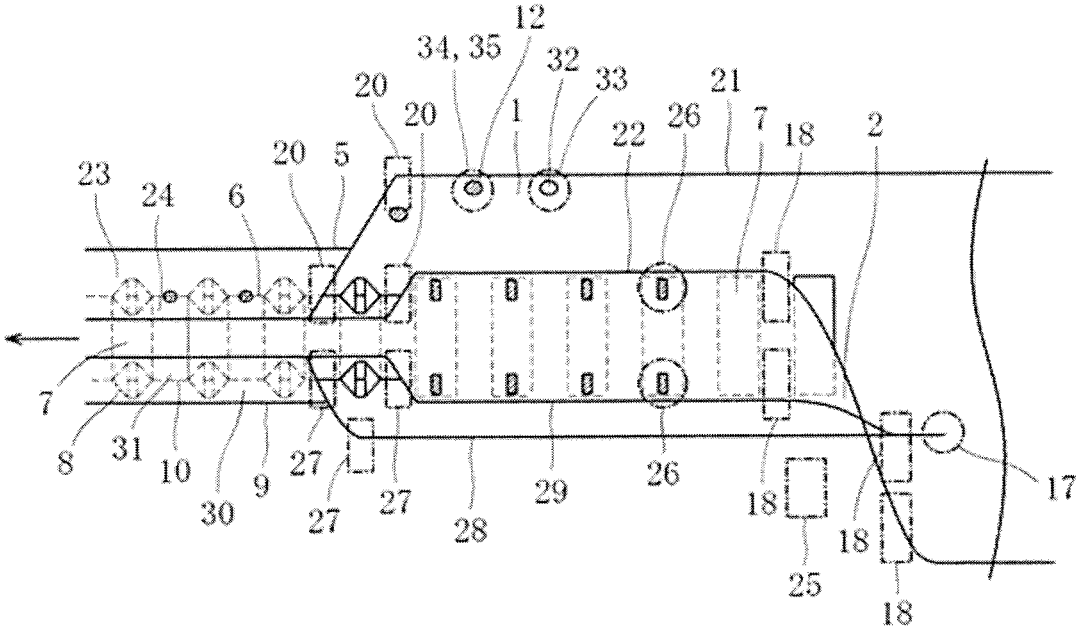
FIG. 5 is a plan view of another embodiment.
Figure 6A:
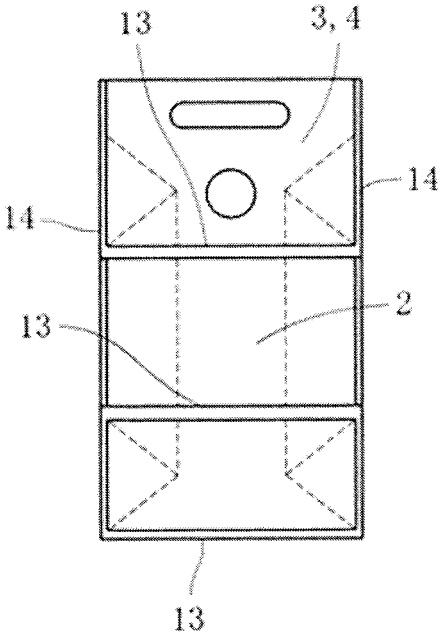
FIG. 6 is a plan view (A) of the plastic bag obtained by the apparatus of FIG. 5 and a perspective view (B) of the plastic bag of (A) after being filled with the content.

FIG. 5 illustrates another embodiment. This embodiment is another type of apparatus which is arranged to successively make plastic bags of FIG. 6. In the plastic bag of FIG. 6, the first and second webs of panel material 1 and 2 are folded along the first and second folded lines 5 and 6 to make the end surface 3 formed, the end surface 3 being provided with the protrusion 4, as in the case of the plastic bag of FIG. 4. The side surfaces are formed by the sheet of side gusset material 7, in which the auxiliary gusset portions 8 are formed. In addition, the first and second webs of panel material 1 and 2 are folded along the third and fourth folded lines 9 and 10 to make the another end surface 11. The plastic bag includes the heat sealed portions 13, 14 and 16, as also in the case of the plastic bag of FIG. 4 (FIG. 6A, B).

Figure 6B:
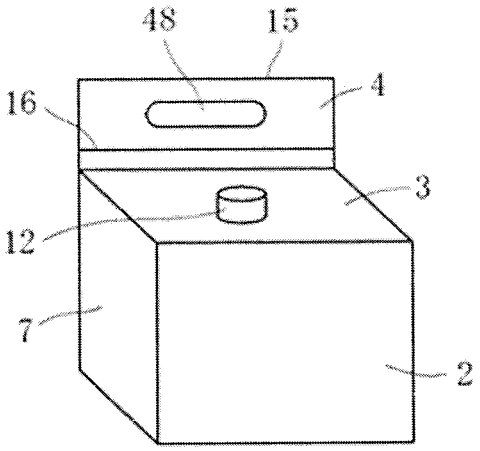

In the plastic bag of FIG. 6, the end surface 6 is provided with not only the protrusion 4 but also the spout 12. The content can therefore be taken out through the spout 12 after being injected.

The protrusion 4 may be provided with a handle hole 48. In this case, the plastic bag can be hung and carried with the handle hole 48. However, the protrusion 4 cannot be provided with the inlet port. The content has to be injected through the spout 12.

In the apparatus of FIG. 5, an aperture 32 is formed in the first web of panel material 1, a spout 12 being inserted into the aperture 32, between the side edge 21 and the first folded line 5, whenever the webs of panel material 1 and 2 are fed intermittently before the first web of panel material 1 is folded. For example, the aperture 32 is formed by the aperture forming device 33, the spout 12 being inserted by the spout inserting device 34, as in the case of the embodiment of FIG. 1. The spout 12 is therefore turned over by the first folded portion 23 when the first web of panel material 1 is folded along the first folded line 5. The first folded portion 23 is therefore provided with the spout 12.

Other steps are the same as the apparatus of FIG. 1. The end surface 3 is therefore provided with not only the protrusion 4 but also the spout 12, after making the plastic bag. The handle hole 48 may be formed in the first folded portion 23 whenever the webs of panel material 1 and 2 are fed intermittently so that the protrusion 4 can be provided with the handle hole 48 after making the plastic bag.

DESCRIPTION OF REFERENCE NUMBERS

1 first web of panel material
2 second web of panel material
3 end surface
4 protrusion
5 first folded line
6 second folded line
7 sheet of side gusset material
9 third folded line
10 fourth folded line
11 another end surface
12 spout
15 inlet port
19 feeding rollers
20 panel material guide device
21 side edge
22 corresponding side edge
23 first folded portion

24 second folded portion
25 side gusset supply device
26 temporarily fixing device
27 additional guide device
28 another side edge
29 corresponding another side edge
30 third folded line
31 fourth folded line
32 aperture
33 aperture forming device
34 spout inserting device

The invention claimed is:

1. An apparatus for successively making plastic bags each of which includes an end surface provided with a protrusion, the protrusion being provided with an inlet port, the apparatus comprising:

a panel material feeding device configured to superpose first and second webs of panel material on each other and fed longitudinally thereof;

a panel material guide device configured to guide the first and second webs of panel material when being fed so that the first web of panel material is folded along a first folded line at a position adjacent to a side edge of first web of panel material while the second web of panel material is folded along a second folded line at a position adjacent to a corresponding side edge of second web of panel material, a first folded portion being formed in the first web of panel material, a second folded portion being formed in the second web of panel material, the first folded portion being superposed on the second folded portion, there existing a distance between the side edge and the first folded line, which is larger than twice a distance between the corresponding side edge and the second folded line by a predetermined distance after the first and second webs of panel material are folded along the first and second folded lines, the side edge and the corresponding side edge being aligned with each other when the first folded portion is superposed on the second folded portion; and a slitting blade configured to slit the first web of panel material along the first folded line when being fed after being folded so that a selvage including the first folded line extended longitudinally of the first and second webs of panel materials is made from the first web of panel material and an opening is formed in the first folded portion, the end surface being formed by the first folded portion, the protrusion being formed by the predetermined distance, the inlet port being formed by the opening.

* * * * *